United States Patent [19]

Breuer et al.

[11] Patent Number: 4,802,255

[45] Date of Patent: Feb. 7, 1989

[54] NOVEL BRUSH FILAMENTS

[75] Inventors: Miklos M. Breuer, Newton; Joseph A. Hanak, Norwell, both of Mass.

[73] Assignee: Gillette Canada Inc., Montreal, Canada

[21] Appl. No.: 83,336

[22] Filed: Aug. 10, 1987

[51] Int. Cl.[4] ..... A46B 9/04

[52] U.S. Cl. ..... 15/159 A; 15/167.1; 8/516; 428/378

[58] Field of Search ..... 15/167.1, 159 A, 186, 15/187, 188, 110; 428/361, 368, 375, 378; 8/149, 150, 516

[56] References Cited

U.S. PATENT DOCUMENTS 2,558,992 7/1951 Stott ..... 8/516
3,258,805 7/1966 Rossnan ..... 15/167.1 X

FOREIGN PATENT DOCUMENTS 79400 5/1983 European Pat. Off. ..... 15/187

*Primary Examiner*—Peter Feldman
*Attorney, Agent, or Firm*—John P. Morley

[57] ABSTRACT

Novel, improved filaments for brushes. The filaments include a colored region provided by a dye colorant and the colored region is adapted to provide a color intensity which can change in response to increased use of the filament to provide a signal indicative of filament wear. The filaments are particularly useful in toothbrushes.

18 Claims, 1 Drawing Sheet

NOVEL BRUSH FILAMENTS

BACKGROUND OF THE INVENTION

1. The Field of the Invention

This invention relates to filaments (or fibers) for brushes. More precisely, this invention relates to novel, improved filaments for oral care brushes and to oral care brushes including the novel improved filaments.

2. Description of the Prior Art

Brushing the teeth is universally rcommended as the most effective way to maintain oral hygiene. While there is disagreement as to the most suitable form of brushing, the toothbrush is acknowledged to be the most effective aid in cleaning the teeth. In turn, the cleaning effectiveness of a toothbrush is dependent on such factors as the brushing habits of the user, the frequency, intensity and duration of brushing and the quality of the brush filaments. There is considerable debate in the art relating to the features which provide a toothbrush having maximized cleaning effectiveness. These factors include the material, size, shape, strength and resiliency of the brush filament and the length, width and overall shape and area of the brushing surface. Other features affecting the cleaning effectiveness of a toothbrush include the number of tufts (bundles of individual filaments), the number of rows of tufts and the arrangement of the tufts on the brush head. However there is general agreement in the art that wear is a crucial factor which can dramatically diminish the effectiveness of a toothbrush in maintaining oral hygiene. For example, the art recognizes and acknowledges that diminished effectiveness of a toothbrush by wear can result in increased plaque accumulation and increased risks to periodontium tissue.

The degree of wear of a toothbrush is primarily a function of the properties of the filament and the mechanical force applied to the brush during brushing. The degree of wear can also be accelerated to some extent by abrasive materials normally contained in dentifrices. Brush wear results in tearing, splaying, expansion and fraying of the filaments and a decrease in strength and resiliency of the filaments which is manifested by single filaments deviating from their original direction. Moreover, wear is manifested by a change in the overall shape and size of the brushing surface area and by changes in the texture of the filament. While toothbrush wear varies from user to user, studies indicate that the average toothbrush subject to average use has a usefull effective life from about eight to twelve weeks. Thereafter, wear causes sufficient deterioration of the filaments to warrant replacement of the brush in order to assure continued maintenance of effective oral hygiene.

Unfortunately, toothbrushes are not usually replaced regularly and oftentimes are used far beyond their effective useful life. As mentioned, the dental profession has recommended replacement of toothbrushes after about three months of use. However, annual toothbrush consumption figures indicate that toothbrush uses replace their toothbrushes about once a year. The dental profession has made an earnest effort to educate the public about the need to assess the wear of a toothbrush being used to determine if it should be discarded and replaced. However, these efforts have had limited success since the user has the responsibility to remember the condition of a toothbrush which should be discarded and to remember to monitor and continually assess the condition of the toothbrush. Accordingly, a more effective approach is needed to provide reliable means to signal or warn a toothbrush user when a toothbrush has become sufficiently affected by wear that it should be discarded and replaced.

The present invention is designed to provide such means to the toothbrush user so that the user can visually detect a signal indicative of toothbrush wear and replace the worn toothbrush. In the present invention, the signal indicative of wear is provided by the use of filaments having the capability to undergo a change in color in response to wear. U.K. Application Ser. No. 2,137,080 discloses plastic bristles or filaments for brushes which also change color in response to wear. The filaments disclosed in the U.K. Application are composite filaments and include a colored core completely surrounded by an outer cover material having a color different from the core color. In the disclosed filaments, the core is a reinforcing element and is relatively hard and stiff to control the rigidity of the filament while the outer cover material is softer than the core material and is more susceptible to wear. In use, the cover material becomes worn in the area of the rounded end of the filament and peels or breaks off to expose the core color to signal that the brush should be discarded.

The filaments of the U.K. Application are disclosed as useful for toothbrushes, paintbrushes, polishing brushes, hairbrushes or clothes brushes. However use of the disclosed filaments in toothbrushes can present problems and disadvantages. One apparent disadvantage involves the differentials between the costs of manufacturing a composite filament and manufacturing a mono-filament. Another disadvantage arises because the filaments are designed to provide a signal indicative of wear which occurs suddenly since wear causes the cover material to peel or break away from the filament end. When the cover material suddenly peels or breaks away, the hard, stiff core is exposed which could damage periodontium tissue unless the toothbrush is discarded immediately. Additionally, when used for toothbrushes, the filaments must present a close coordination between the degree of wear and use of the filament needed to cause the peeling or breaking away of the cover material and the capability of the cover material to effectively perform the teeth cleaning function. In other words, the sudden occurrence of the signal should closely coincide with the failure of the cover material to continue to effectively perform its assigned cleaning function. According to the U.K. Specification, the close coordination is controlled by adjustment of the thickness of the cover material and/or by adjustment of the material used as the cover material. Control of the coordination by adjustment of the thickness and/or of the material of the cover material requires close, precise monitoring of the application of the cover material to the core and close monitoring of the quality of materials selected to assure that the cover material provides consistenly uniform performance characteristics. These features can add to the overall costs in manufacturing composite filaments.

BRIEF SUMMARY OF THE INVENTION

The invention provides novel, improved brush filaments and novel, improved brushes such as toothbrushes including the filament. Essentially, the filaments of the present invention are mono-filaments which include a longitudinal surface providing a boundary about the cross-sectional area of the filament and the longitudinal surface and/or the cross-sectional area presents a colored region adapted to provide a visual signal indicative of wear in response to filament use. The filaments can be natural or synthetic materials and may or may not be initially colored such as by pigments or dyes. In filaments of the present invention, the colored region provides an initial color or color intensity viewable to the user. As wear is produced by continuing use of the filaments, the intensity of the colored region changes to a point which signals the user that the filament no longer provides the requisite performance characteristics for effectively performing its assigned function.

THE DRAWINGS

DESCRIPTION OF PREFERRED EMBODIMENTS

Figure 1:
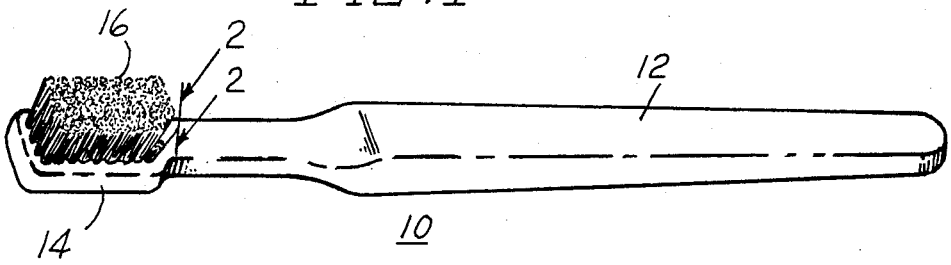
FIG. 1 is a diagrammatic perspective view of a representative toothbrush including the novel filaments of the invention.

In the preferred embodiments of the present invention, the novel filaments are used in toothbrushes of the type shown in FIG. 1. As shown there, the toothbrush 10 includes a handle 12 and a head 14 having a plurality of tufts 16. Tufts 16 comprise a plurality of individual filaments (20 FIG. 2) and, tufts 16 are securely affixed in or attached to head 14 in manners known to the art. The configuration of head 14 can vary and may be oval, convex curved, flat trim and serrated V or any other desired configuration. Additionally, the configuration, shape and size of handle 12 or tufts 16 can vary and the axes of handle 12 and head 14 may be on the same or a different plane. Preferred filaments for use in toothbrushes are polymeric filaments and especially polyamide or polyester filaments. The longitudinal and cross-sectional dimensions of the filaments of the invention and the profile of the filament ends can vary and the stiffness, resiliency and shape of the filament end can vary. Preferred filaments of the present invention have substantially uniform longitudinal lengths between about 3 to about 6 cm., substantially uniform cross-sectional dimensions between about 100 to about 350 microns and have smooth or rounded tips or ends.

Figure 2:
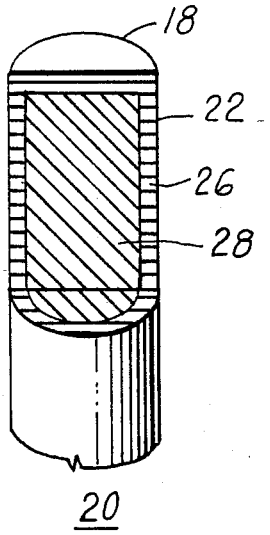
FIGS. 2 and 3 are magnified, diagrammatic views of novel filaments of the invention taken along line 2—2 of FIG. 1 with a portion of the filaments broken away.
Figure 4:
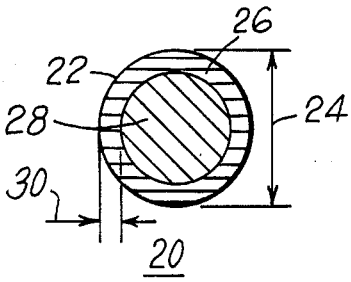
FIGS. 4 and 5 are magnified, diagrammatic cross-sectional views of filaments of FIGS. 2 and 3 respectively.

FIGS. 2 and 4 diagramatically represent a filament of the present invention. As shown in the Figures, filament 20 includes longitudinal surface 22 which terminates at a tip or end 18 and defines the boundary of the cross-sectional area 24 of the filament. Cross-sectional area 24 includes two colored regions 26 and 28 which have different colors or different color intensities. Colored region 26 extends at least about surface 22 or preferably extends from surface 22 inwardly into a portion of cross-sectional area 24 to provide a distance or degree of dye penetration 30 (FIG. 4) of region 26 into cross-sectional area 24. Preferably, colored region 26 provides an annular ring having a substantially uniform degree of penetration. In either event, colored region 28 occupies the remaining portion of cross-sectional area 24. Accordingly, color region 26 progvides an initial color intensity or color which is predominant and more conspicuous to the toothbrush user while the color intensity of region 28 is less conspicuous. However, in response to wear produced by progressive brushing, the initial color intensity of region 26 changes and after sufficient wear, the change in color intensity of region 26 signals the user that the filament is no longer effective.

In the preferred practise of the invention, colored region 26 is provided by a ring dyeing process. In ring dyeing processes, the filament is contacted with a dye for a time sufficient to at least color surface 22 and preferably to also penetrate into a portion of cross-sectional area to provide a degree of dye penetration 30. Before dyeing, the filaments may be transparent, translucent or colored such as by dyes or pigments. Preferred dyes for providing region 26 are food dyes or certified food colorants. Representative suitable food dyes or colorants are FD&C Red No. 40, Erythrosine (FD&C Red No. 3), Brillant Blue FCF (FD&C Blue No. 1), Indigotine (FD&C Blue No. 2), Tartrozine (FD&C Yellow No. 5), Sunset Yellow FCF (FD&C Yellow No. 6) and Fast Green FCF (FD&C Green No. 3). In dyeing NYLON brush filaments, food dyes or colorants such as those mentioned above, are preferably used in the form of buffered aqueous solutions which include amounts of dye up to about 5 percent by weight or somewhat higher. Depending upon the amount of buffer, the pH of such aqueous dye solutions can range from about 1.3 to about 13 and preferably between 3 to about 12. Suitable buffers include potassium phosphate, sodium hydroxide, potassium carbonate, potassium borate and potassium hydroxide. Representative suitable concentrations of buffers are between about 0.025 to about 0.2 moles per liter of the aqueous dye solutions.

The degree of dye penetration and the degree of dye fastness of a selected filament is coordinated with the wear characteristics of the filament so that the change in color intensity provides a reliable indication of filament deterioration due to wear. In general, with NYLON brush filaments, suitable coordination between the distance or degree of dye penetration and dye fastness and the filament's wear characteristics can be achieved if region 26 (FIG. 2) has an average degree of dye penetration 30 equivalent to about 20 percent or less of the value W/2 where W is the maximum cross-sectional width of the filament. For most filaments, the W/2 value will be the radius. Generally, the average degree of dye penetration 30 is equivalent to about 10 percent of less. when dyeing NYLON filaments with dye solutions of the type described before, the dye solution temperature and pressure and the time of filament immersion are factors providing control over the degree of dye penetration and dye fastness achieved. The degree of dye penetration and dye fastness both increase with increased dye solution temperature and pressure and with increased immersion time. In laboratory scale dyeing of NYLON filaments, representative preferred dye solution temperatures were between about 40° C. to boiling temperatures, representative suitable pressures were between 1 to about 5 atmospheres and representative preferred immersion times were between about 10 minutes to about 3 hours. Dye rate enhancing solvents and/or surfactants may also be used to control the degree of dye penetration and dye fastness.

As mentioned, the filament of FIGS. 2 and 4 can be transparent or translucent or colored by pigments or dyes prior to being dyed to provide region 26. Accordingly, after dyeing and after being subjected to sufficient wear and use, the filament will present a substantially uniform color intensity which will at least approximate the initial color intensity of the pre-dyed filament. Filaments of FIGS. 2 and 4 may also be dyed with combinations of dyes to provide region 26. Each dye used in such combinations may provide a color intensity having substantially the same resistance to change in response to wear and use or each dye may provide a color intensity having a different resistance to change in response to wear and use. For example, the filament may be dyed with two dyes in which one dye is more resistant to change in response to wear and use than the other. In this case, the color intensity of region 26 will change in response to wear and use to provide a color intensity which will be predominantly provided by the more resistant dye. Additionally region 26 may or may not extend along the entire length of longitudinal surface 22. For example, region 26 can extend along only a portion of the length of surface 22 such as a portion including the filament tip which is normally subjected to more intense conditions of wear than other portions of the filament. In this case, the color intensity of the portion of the length of surface 22 including region 26 will change in response to wear and use. After sufficient wear and use, the color intensity along the entire length of surface 22 will be substantially uniform.

Figure 3:
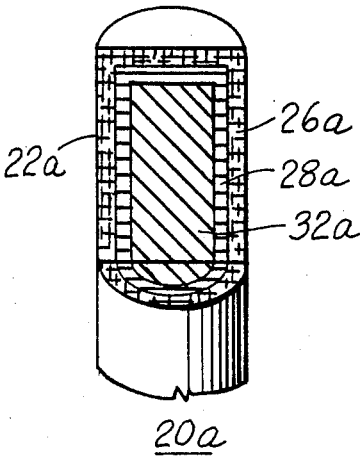
Figure 5:
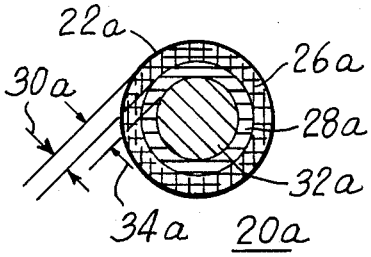

Ring dyeing processes may also be employed to provide filaments of the type shown in FIGS. 3 and 5 in which filament 20*a* has three regions 26*a*, 28*a* and 32*a* with each region having a different color. Filament 20*a* may be prepared by first dyeing filament 20*a* with a dye of a selected color under conditions to provide a degree of dye penetration 34*a* (FIG. 5). Thereafter filament 20*a* is dyed with a dye of another selected color to provide another degree of dye penetration 30*a* (FIG. 5). The respective degrees of penetration 30*a* and 34*a* can be adjusted so that the change in color intensity of region 26*a* signals the user that the toothbrush should be replaced or so that the change in color intensity of both region 26*a* and 32*a* signals the user that the toothbrush should be replaced. In a filament of FIGS. 3 and 5, colored region 26*a* preferably extends about surface 22*a* or has a low degree of penetration equivalent to less than about 5 percent of the cross-sectional area of the filament.

The invention and manners of making and using the invention will be more fully appreciated from the following non-limiting, illustrative Examples.

Example 1

A buffered solution having pH of 5.0 was prepared by adding 1.64 grams of sodium acetate to 100 mls. distilled water and adjusting the pH to 5.0 with hydrochloric acid. One gram of Erythrosine (FD&C Red No. 3) was added to the buffered solution to provide a buffered solution containing about 1 percent by weight Erythrosine. The Erythrosine solution was heated to its boiling temperature. Circular TYNEX NYLON filaments having a cross-sectional diameter of 200 microns and a laongitudinal length of 3.50 cm were immersed in the boiling Erythorosine solution for 60 minutes. After removal of the dyed filaments from the Erythrosine solution, the filaments were washed with water followed by acetone and dried overnight in an oven at 40° C.

Some of the dyed filaments were embedded into a cold curing SERAFIX polyester resin and the surface of the resin was polished down to reveal the cross-sectional area of the embedded filaments. Microscopic examination of the cross-sectional area of the filaments revealed that the dye had penetrated into the cross-sectional area to provide a dyed ring-like region extending inwardly from the longitudinal surface of the filament into the cross-sectional area and extending about the circumference of the filament. Measurements of the degree of dye penetration (30 FIG. 4) into the cross-sectional area 24 revealed that the average degree of penetration was equivalent to about 2.5 percent of the radius of the filament.

Example 2

As mentioned, the degree of dye penetration can be controlled by such factors as the temperature of the solution and the time of immersion of the filament in the solution. In this Example, the conditions of Example 1 were repeated but the filaments remained immersed in the Erythorosine solution for three hours. Microscopic examination of dyed fibers of this Example revealed that an increased degree of penetration of the dye into the cross-sectional area of the filament had been achieved. Measurements revealed that the average degree of dye penetration (30 FIG. 4) was equivalent to about 8 percent of the radius of the filament.

Example 3

Circular, blue pigmented NYLON 12-6 filaments having a diameter of 200 microns were dyed with a boiling dye solution containing 1 percent by weight FD&C Yellow No. 6 and 0.000004 percent by weight FD&C Red No. 3. The ratio of the volume of the dye solution to the mass of the filament was about 25:1 and the filaments were maintained in the boiling solution for 60 minutes. After removal of the dyed filaments from the solution, the filaments were washed with water followed by acetone and dried in air at ambient temperature. The filament had a grayish white color and the degree of dye penetration was visually estimated to be about 4 percent of the radius of the filament.

Example 4

Circular, unpigmented, translucent NYLON 12-6 filaments having a diameter of about 200 microns were dyed with a solution containing 250 mls. water, 0.001 percent by weight FD&C Blue No. 2 and 0.3 percent by weight acetic acid. The filaments and dye solution were added to a pressure vessel which was maintained at a temperature of 121° C. and a pressure of 2 atmospheres for 60 minutes. Measurements revealed that the average degree of dye penetration was equivalent to about 22.38 percent of the radius of the filament.

Example 5

Example 4 was repeated but the pressure vessel was maintained at the 121° C. and two atmospheres for 20 minutes. Measurements revealed that the degree of dye penetration was equivalent to about 11.6 percent of the radius of the filament.

Example 6

Example 5 was repeated but the dye solution included 0.0005 percent by weight FD&C Blue No. 2. Measurements revealed that the degree of dye penetration was equivalent to about 5.47 percent of the radius of the filament.

Example 7

In order to demonstrate the coordination between the degree of penetration of colored region 26 of a filament of FIGS. 2 and 4 and the degree of wear and use of the filament, toothbrushes were prepared including the filaments of Example 1. The toothbrushes included a conventional toothbrush head and handle of a cellulosic polymer. The head included forty-eight tufts each containing eighteen to twenty filaments with the tufts arranged in four rows of twelve tufts each. The toothbrushes were given to employees who were instructed to use the brush in accordance with their normal brushing habits and routine with a dentifrice of their choice. The brushes were evaluated after periods of four, eight and twelve weeks of use which are referred to as Period 1, Period 2 and Period 3 respectively in Table 1 below. The evaluation involved visual examinations of the shape of the brushing surface area and the color of the filaments. The shape of the brushing surface area is an indication of wear while the change in intensity of the color of the filaments is also an indication of wear. Based on the evaluation, the shape and color were rated "good" or "bad". The results are shown in Table 1 below.

TABLE 1

| | Good | Bad | Total | % Bad |
|---|---|---|---|---|
| Period 1 - Shape | 27 | 3 | 30 | 10.00 |
| Period 1 - Color | 28 | 2 | 30 | 6.67 |
| Period 2 - Shape | 49 | 11 | 60 | 18.33 |
| Period 2 - Color | 52 | 8 | 60 | 13.33 |
| Period 3 - Shape | 38 | 24 | 62 | 38.71 |
| Period 3 - Color | 33 | 27 | 60 | 45.00 |

Based on the above data a chi-square test for independence between color and shape indicated a significant relationship between shape and color. The correlation coefficient between shape and color was 0.47.

Example 7 illustrates that an acceptable degree of correlation between filament wear and change in color intensity was achieved for the dyed filaments prepared according to the described laboratory-scale procedures. As mentioned, the degree of correlation between filament wear and change in color intensity depends on various factors primarily including the selected filament material and the physical and chemical properties of the filament material as well and the selected dye (or dyes) and condition of dyeing. Accordingly, the desired degree of correlation can be determined empirically by subjecting a selected filament material to various dyes and conditions of dyeing to establish the degree of dye penetration and dye fastness needed to provide the desired correlation. The preferred degree of correlation is one in which the change in color intensity which signals that the brush should be discarded will occur after about three months of average use by the average user.

We claim:

1. A monofilament for a toothbrush, said filament having a longitudinal surface defining the maximum width (W) of the cross-sectional area of the filament which includes a first colored region provided by a dye colorant and which extends along at least a portion of the longitudinal surface, said first colored region being arranged in association with another portion of the cross-sectional area providing at least one different colored region, said first colored region providing a color intensity which can change in response to increased use of the filament to provide a signal indicative of wear.

2. A filament of claim 1 where the first colored region extends along the entire longitudinal surface.

3. A filament of claim 1 where the first colored region extends inwardly into a portion of the cross-sectional area for a distance equivalent to about 20 percent or less of the value W/2.

4. A filament of claim 3 where the colored region provides an annular ring extending inwardly for a substantially uniform distance.

5. A filament of claim 3 including a dye or a pigment substantially uniformly dispersed throughout the filament.

6. A filament of claim 3 where the first colored region extends inwardly into a portion of the cross-sectional area for a distance equivalent to about 10 percent or less of the value W/2.

7. A filament of claim 6 where the colored region provides an annular ring extending inwardly for a substantially uniform distance.

8. A filament of claim 6 including a dye or a pigment substantially uniform dispersed throughout the filament.

9. A filament of claim 1 where the dye colorant is a food dye.

10. A toothbrush including a handle associated with a head having at least one tuft securely affixed in or attached to the head, said tuft including a plurality of filaments of claim 1.

11. A toothbrush of claim 10 where said filaments are filaments of claim 2.

12. A toothbrush of claim 10 where said filaments are filaments of claim 3.

13. A toothbrush of claim 10 where said filaments are filaments of claim 4.

14. A toothbrush of claim 10 where said filaments are filaments of claim 5.

15. A toothbrush of claim 10 where said filaments are filaments of claim 6.

16. A toothbrush of claim 10 where said filaments are filaments of claim 7.

17. A toothbrush of claim 10 where said filaments are filaments of claim 8.

18. A toothbrush of claim 10 where said filaments are filaments of claim 9.

* * * * *